US011365035B2

(12) United States Patent
Santini et al.

(10) Patent No.: US 11,365,035 B2
(45) Date of Patent: Jun. 21, 2022

(54) SEAL RELEASING CLOSURE ASSEMBLY

(71) Applicant: TECNOCAP, LLC, Glen Dale, WV (US)

(72) Inventors: Federico Santini, Wheeling, WV (US); Carmine Barbato, Salerno (IT)

(73) Assignee: TECNOCAP, LLC, Glen Dale, WV (US)

( * ) Notice: Subject to any disclaimer, the term of this patent is extended or adjusted under 35 U.S.C. 154(b) by 483 days.

(21) Appl. No.: 16/466,578

(22) PCT Filed: Dec. 7, 2017

(86) PCT No.: PCT/US2017/065179

§ 371 (c)(1),
(2) Date: Jun. 4, 2019

(87) PCT Pub. No.: WO2018/106960

PCT Pub. Date: Jun. 14, 2018

(65) Prior Publication Data

US 2019/0344941 A1 Nov. 14, 2019

Related U.S. Application Data

(60) Provisional application No. 62/431,117, filed on Dec. 7, 2016.

(51) Int. Cl.

| | |
|---|---|
| ***B65D 51/14*** | (2006.01) |
| ***B65D 43/02*** | (2006.01) |
| ***B65D 45/30*** | (2006.01) |

(52) U.S. Cl.

CPC ..... *B65D 51/145* (2013.01); *B65D 43/0231* (2013.01); *B65D 45/30* (2013.01); *B65D 2251/20* (2013.01)

(58) Field of Classification Search

CPC .. B65D 51/145; B65D 51/14; B65D 51/1633; B65D 43/0231; B65D 41/3423; B65D 2401/25; B65D 45/30; B65D 2251/20

See application file for complete search history.

(56) References Cited

U.S. PATENT DOCUMENTS 3,836,033 A 9/1974 Podesta
4,694,969 A * 9/1987 Granat ..... B65D 41/3423 215/252

(Continued)

FOREIGN PATENT DOCUMENTS

AU 2017370714 2/2020
BR 112019010293 9/2019

(Continued)

OTHER PUBLICATIONS

"International Application Serial No. PCT/US2017/065179, International Search Report dated Feb. 22, 2018", 2 pgs.

(Continued)

*Primary Examiner* — Don M Anderson
(74) *Attorney, Agent, or Firm* — Schwegman Lundberg & Woessner, P.A.

(57) ABSTRACT

A seal releasing lid assembly includes a lid configured for coupling across a container opening of a container. The lid includes a lid surface and a lid wall extending from the lid surface. The lid wall includes a lid edge and a slidable coupling surface between the lid edge and the lid surface. The assembly includes a retaining and releasing ring configured for coupling with the container and with the lid. The retaining and releasing ring includes a ring flange and a release ridge. A ring wall extends from the ring flange to the release ridge. The retaining and releasing ring includes decoupling and release ready configurations. In the decoupling configuration the release ridge is slidably coupled along the lid wall. In the release ready configuration the (Continued)

release ridge is seated beneath the lid edge and slidably disengaged from the lid wall.

13 Claims, 5 Drawing Sheets

(56) References Cited

U.S. PATENT DOCUMENTS

| | | | | |
|---|---|---|---|---|
| 5,443,853 | A | 8/1995 | Hayes | |
| 5,803,298 | A * | 9/1998 | Hausmann | B65D 43/0216 220/319 |
| 6,276,543 | B1 | 8/2001 | German et al. | |
| 8,636,161 | B2 | 1/2014 | Dunwoody | |
| 9,387,959 | B2 | 7/2016 | Dunwoody | |
| 2004/0016758 | A1 | 1/2004 | Richardson | |
| 2007/0095781 | A1* | 5/2007 | Wan | B65D 41/0492 215/276 |
| 2015/0101912 | A1 | 4/2015 | Morris et al. | |
| 2015/0122769 | A1 | 5/2015 | Taber et al. | |

FOREIGN PATENT DOCUMENTS

| | | |
|---|---|---|
| EP | 0269920 | 6/1988 |
| EP | 1686070 | 8/2006 |
| NZ | 753298 B2 | 2/2021 |

OTHER PUBLICATIONS

"International Application Serial No. PCT/US2017/065179, Written Opinion dated Feb. 22, 2018", 4 pgs.

"International Application Serial No. PCT US2017 065179, International Preliminary Report on Patentability dated Sep. 30, 2019", 16 pgs.

"Australian Application Serial No. 2017370714, First Examination Report dated Nov. 8, 2019", 2 pgs.

"New Zealand Application Serial No. 753298, First Examiner Report dated Nov. 15, 2019", 2 pgs.

"European Application Serial No. 17878896.4, Response filed Jan. 20, 2020 to Communication pursuant to Rules 161(2) and 162 EPC dated Jul. 16, 2019", 11 pgs.

"Australian Application Serial No. 2017370714, Response filed Feb. 11, 2020 to First Examination Report dated Nov. 8, 2019", 13 pgs.

"European Application Serial No. 17878896.4, Extended European Search Report dated Aug. 7, 2020", 7 pgs.

"New Zealand Application Serial No. 753298, Response filed Sep. 11, 2020 to First Examiner Report dated Nov. 15, 2019", 50 pgs.

"Brazilian Application Serial No. BR112019010293-0, Office Action dated Sep. 27, 2021", w/o English translation, 4 pgs.

"European Application Serial No. 17878896.4, Communication Pursuant to Article 94(3) EPC dated Aug. 26, 2021", 5 pgs.

"European Application Serial No. 17878896.4, Response filed Mar. 4, 2021 to Extended European Search Report dated Aug. 7, 2020", 17 pgs.

"European Application Serial No. 17878896.4, Response Filed Mar. 4, 2022 to Communication Pursuant to Article 94(3) EPC dated Aug. 26, 2021", 10 pages.

"Brazilian Application Serial No. BR112019010293-0, Response filed May 2, 2022 to Office Action dated Sep. 27, 2021", with English claims, 41 pages.

* cited by examiner

SEAL RELEASING CLOSURE ASSEMBLY

CLAIM OF PRIORITY

This application is a U.S. national stage application filed under 35 U.S.C. § 371 from International Application Serial No. PCT/US2017/065179, filed on Dec. 7, 2017, and published as WO 2018/106960 on Jun. 14, 2018, which claims the benefit of priority of Santini et al. U.S. Provisional Patent Application Ser. No. 62/431,117 entitled "SEAL RELEASING CLOSURE ASSEMBLY," filed on Dec. 7, 2016, each of which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Tecnocap, LLC; 1701 Wheeling Avenue; Glen Dale, W. Va. All Rights Reserved.

TECHNICAL FIELD

This document pertains generally, but not by way of limitation, to closures used with containers, vessels or the like.

BACKGROUND

Containers are filled with and store contents including fluids such as perishable foods and drinks, cleaning fluids, gases or the like. In some examples the containers store their contents with a relative negative pressure (e.g., a vacuum) to affirmatively engage a lid with the container and prevent the ingress of bacteria, contaminants or the like. The lid is pried away from the container, for instance with a knife or other instrument, to open the container.

In other examples, the container includes a disk captured within a skirt surrounding the disk. The skirt includes a lug within the portion of the skirt that captures the disk (between two curls). Rotation of the skirt engages the lug with the lid and biases the lid away from the container.

SUMMARY

The present inventors have recognized, among other things, that a problem to be solved can include decoupling between a release ring and a lid coupled with a container. As described herein, in some examples a disk is captured within a skirt and the assembly of both is retained with a container until opening of the container is desired. Accordingly, the skirt remains with the disk and the container after sealing of the disk, during storage, and until the assembly is decoupled from the container.

The present subject matter can help provide a solution to this problem, such as by providing a seal releasing lid assembly including a lid and a retaining and release ring configured for coupling and decoupling from the lid while at the same time assisting with opening of the lid. In one example, the retaining and releasing ring includes a ring wall and a release ridge. The release ridge is slidably coupled along a lid wall of the lid from a lid surface to a lid edge in a decoupling configuration. Passage of the release ridge beneath the lid edge seats the release ridge beneath the lid edge in a release ready configuration. Thereafter, movement of the retaining and releasing ring (e.g., rotation in an opening direction, such as counter clockwise) engages the release ridge with the lid edge and biases the lid away from the container to break the seal.

Where decoupling of the retaining and release ring is desired (e.g., for use of the ring with another container and lid) the ring is unscrewed while the lid is held on the container, for instance with finger pressure. The release ridge of the ring readily slides over the lid edge and onto the lid wall (transitions the ring to the decoupling configuration) . Continued movement of the release ridge moves the release ridge past the lid wall and decouples the retaining release ring from the lid while leaving the lid sealed to the container.

Conversely, a single retaining and release ring is optionally used to open a plurality of containers with sealed lids. The ring is coupled around the lid on a container with the release ridge slidably coupling along the lid wall and the ridge is then seated beneath the lid edge (and slidably disengaged from the lid wall). Movement of the retaining and releasing ring relative to the container and the Rd (e.g., rotation in an opening direction) engages the release ridge with the lid edge and biases the lid away from the container and breaks the seal.

Optionally, the retaining and release ring remains coupled with the lid sealing the container (e.g., the ring is not decoupled). Instead, the retaining and releasing ring remains with the lid to facilitate reuse of the lid, for instance, after opening and removing of some of the contents of the container. The retaining and releasing ring is used as described herein to bias the lid away from the container. The retaining and releasing ring is then used in combination with the lid to reclose and store the remainder of the contents.

This overview is intended to provide an overview of subject matter of the present patent application. It is not intended to provide an exclusive or exhaustive explanation of the disclosure. The detailed description is included to provide further information about the present patent application.

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

DETAILED DESCRIPTION

Figure 1:
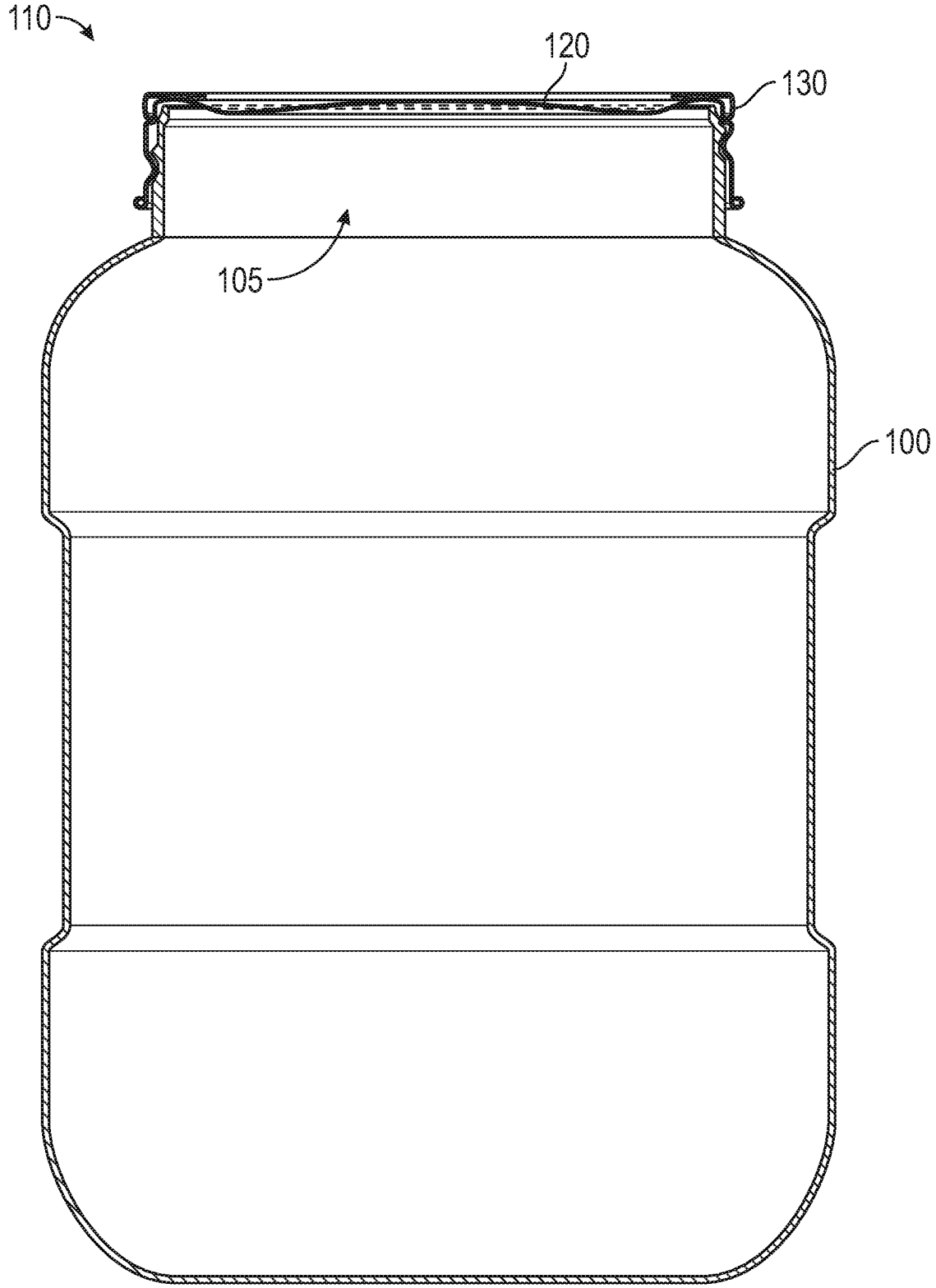
FIG. 1 illustrates a container with a seal releasing lid assembly.

FIG. 1 illustrates a container 100 with a seal releasing closure assembly 110. In the example shown, the container 100 includes a cavity and a container opening 105. The container 100 is optionally filled with a product, such as perishable foods and drinks, cleaning fluids, gases or the like. The seal releasing closure assembly 110 includes a lid 120 coupled to the container 100. The seal releasing closure assembly 110 further includes a retaining and releasing ring 130 coupled to the container 100 and the lid 120 in the configuration shown in FIG. 1. In one example, the retaining and releasing ring 130 receives the lid 120. As shown, the lid 120 is retained (e.g., held in position over the container opening) with the retaining and releasing ring 130.

The seal releasing closure assembly 110 described herein is removably coupled with the container 100. Referring again to FIG. 1, the lid 120 is applied to, or mated (e.g., coupled) with the container 100, for instance across the container opening. When coupled, the lid 120 covers or closes the container opening.

The retaining and releasing ring 130 can be coupled with the container 100. The retaining and releasing ring 130 can be coupled with the lid 120. Coupling the retaining and releasing ring 130 with the container 100 can prevent the lid 120 from separating de-mating) from the container 100.

In one example, the container 100 can is with a foodstuff or other perishable product. The container 100 including the seal releasing closure assembly 110 enclosing a perishable product therein is optionally placed in a cooking vessel (e.g., a stock pot, a canning pot, or the like) and heated for a period of time. After heating, the container 100 cools. The cooling of the container 100, and the perishable product such as food enclosed within the container 100 with the seal releasing closure assembly 110 creates a vacuum (low pressure relative to ambient) within the container 100. The pressure difference between interior and exterior of the container generates a vacuum seal between the lid 120 and the container 100. Establishing the seal prevents the contents (e.g., perishable products such as foods) in the container 100 from escaping the container 100 and further prevents the ingress of contaminants, such as bacteria or other microorganisms.

The seal, in some examples, makes the lid 120 difficult to remove from the container 100. The retaining and release ring 130 of the seal releasing closure assembly 110 described herein facilitates the removal of the lid 120 with one or more of the lid 120 tightly sealed to the container 100 or by those with limited manual dexterity (e.g., due to arthritis, lack of strength or the like).

Figure 2:
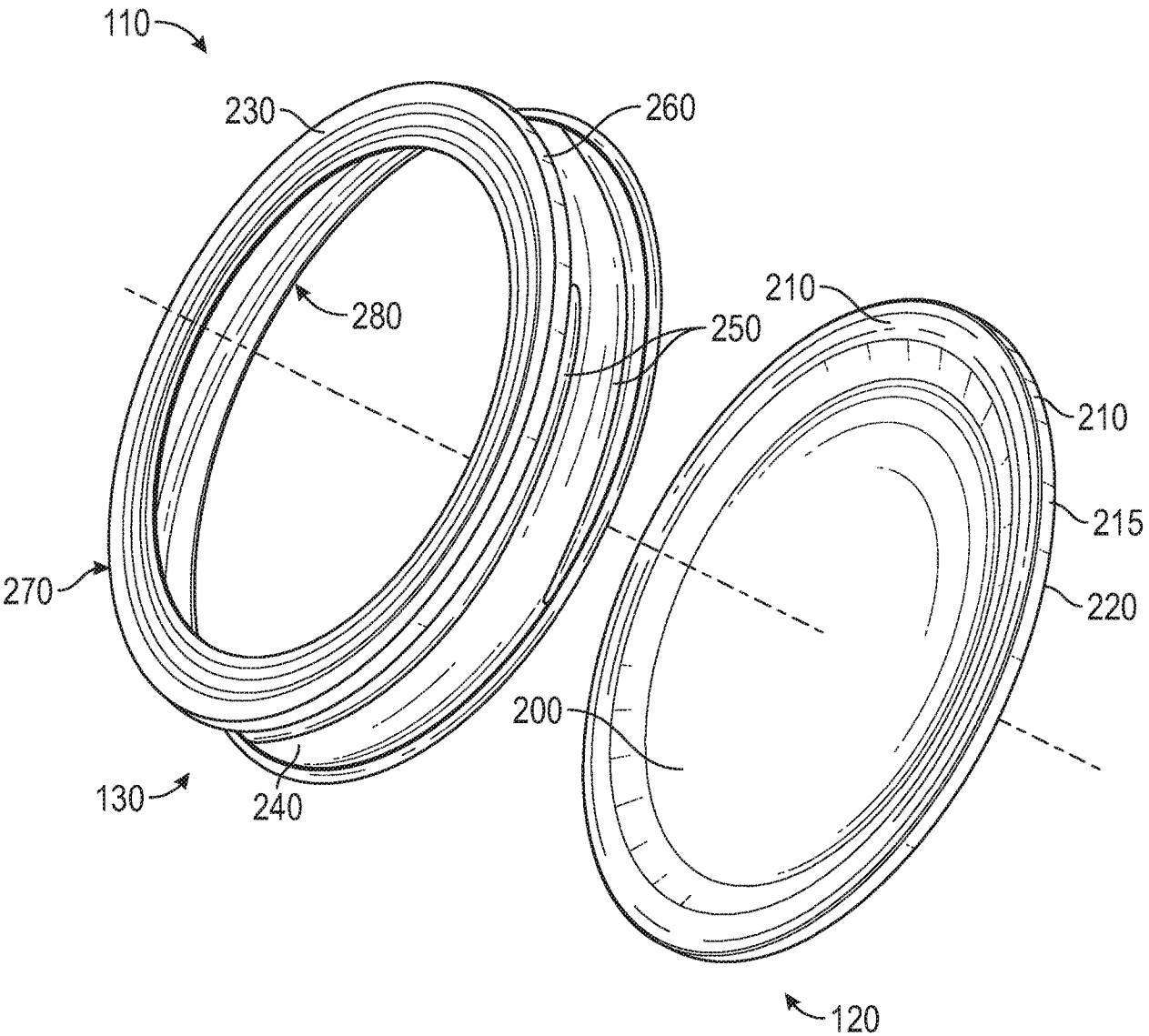
FIG. 2 illustrates a perspective view of the seal releasing lid assembly.

FIG. 2 illustrates a perspective view of one example of the seal releasing lid assembly 110. As shown in FIG. 2, the seal releasing lid assembly 110 in an example includes the lid 120. In another example, the seal releasing lid assembly 110 separately provided from the lid 120. The lid 120 includes a lid surface 200 and a lid wall 210 extending from the lid surface 200. A lid edge 220 is provided along the lid wall 210, for instance proximate an end of the lid wall 210 opposite the lid surface 200. Optionally, the lid edge 220 is part of the lid wall 210 and is located at a periphery of the remainder of the lid wall 210. The lid 120 includes a slidable coupling surface 125. In another example, the slidable coupling surface 125 is included with the lid wall 210. The slidable coupling surface can be positioned between the lid edge 220 and the lid surface 200.

The seal releasing lid assembly 110 includes the retaining and releasing ring 130. Referring again to FIG. 2, the retaining and releasing ring 130 includes a ring flange 230 in the example shown. A ring wall 240 extends from the ring flange 230, and a threading bead 250 is provided along the ring wall 240.

The retaining and releasing ring 130 includes a release ridge 260. The ring flange 230 couples with (e.g., mates with, is in communication with, engages with, extends over, or the like) a portion of the lid surface 200. In another example, at least a portion of the ring flange 230 couples along the lid wall 210 of the lid 120. The ring wall 240 of the retaining and releasing ring 130 extends from the ring flange 230 to the release ridge 260. As further shown in FIG. 2, the ring wall 240 extends from the ring flange 230 to the threading bead 250. As described herein, the ring wall 240 positions the release ridge 260 in an intercepting position relative to the lid 120, for instance the lid edge 220. Optionally, the elasticity, or Young's Modulus, of the ring wall 240 biases the release ridge 260 inwardly toward the lid wall 210 of the lid 120. As further shown in FIG. 2, in this example the release ridge 260 is positioned between the ring flange 230 and the threading bead 250.

Referring again to FIG. 2, the retaining and releasing ring 130 includes a flange end 270 and a trumpet end 280. The flange end 270 optionally includes a first dimension, such as a first diameter, and the trumpet end 280 includes a second dimension, such as a second diameter greater than the first diameter. In one example, the ring wall 240 also includes one or more of the first or second dimensions (e.g., the ring wall 240 transitions between the first and second dimensions).

The threading bead 250 is optionally formed in the retaining and releasing ring 130. The threading bead 250 engages with corresponding threads on the container 100 (shown herein in FIG. 5). The trumpet end 280 of the retaining and releasing ring 130 optionally assists threading of the threading bead 250 with the corresponding threads on the container 100.

As described herein, the retaining and releasing ring 130 includes one or more of decoupled and release ready configurations. The decoupled configuration is exaggerated in FIG. 2 (e.g., exploded) and includes the release ridge 260 above the lid surface 200. The decoupled configuration includes that the release ridge 260 slidably disengaged from the lid wall 210. In the decoupled configuration the lid 120 is optionally separated from the retaining and release ring 130.

Figure 3:
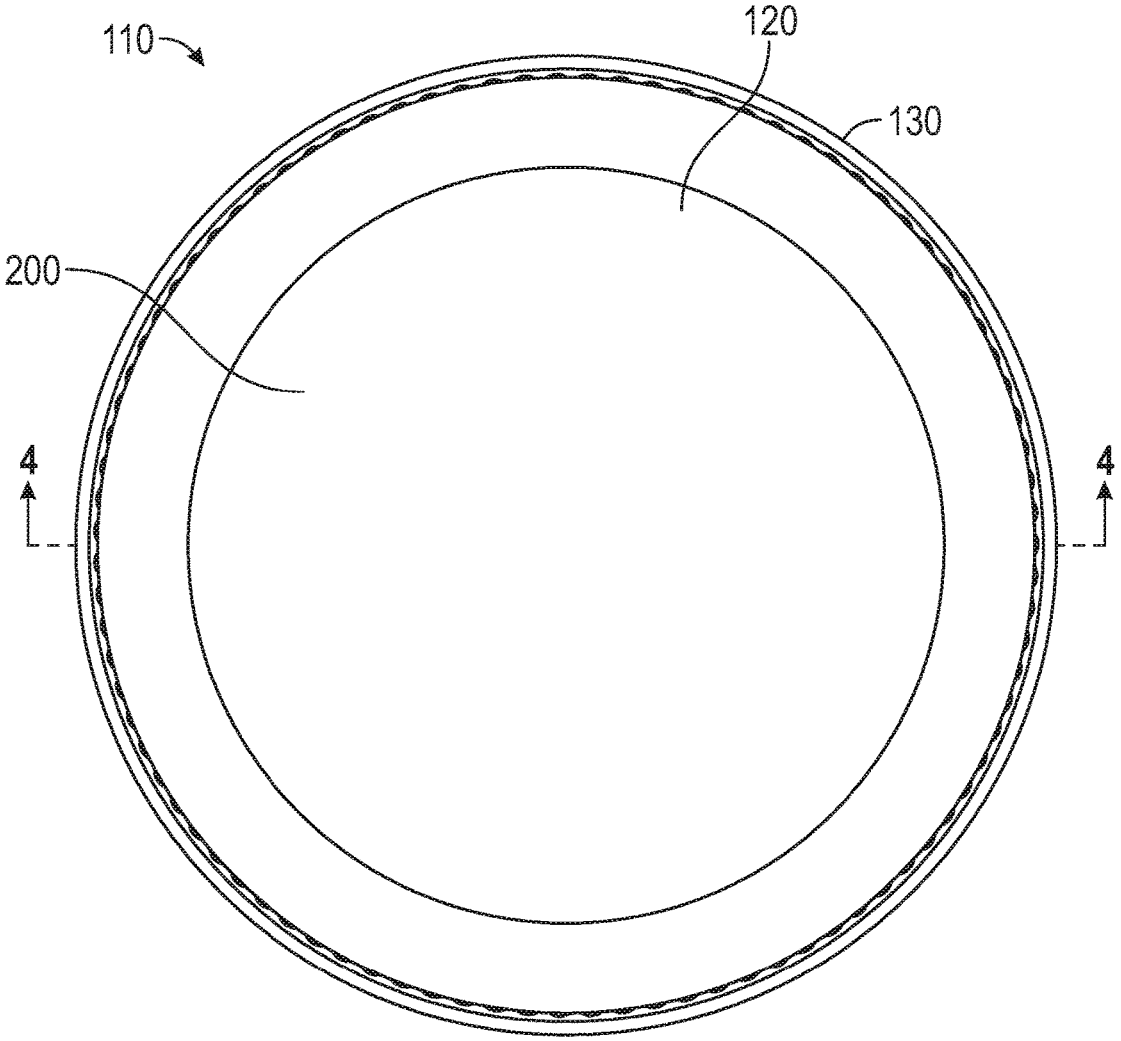
FIG. 3 illustrates a top view of the seal releasing lid assembly.

FIG. 3 illustrates a top view of one example of the seal releasing lid assembly 110. In some examples, the retaining and releasing ring 130 includes an aperture. The aperture allows for the lid surface 200 to be exposed (e.g., visible) when the lid 120 is coupled to the container 100. The aperture allows the lid surface 200 to be exposed when the retaining and releasing ring 130 is coupled to the container 100. Configuring the lid surface 122 to be exposed allows an individual to interact with (e.g., apply a force to, or write upon) the lid 120 independently from the retaining and releasing ring 130.

Figure 4:
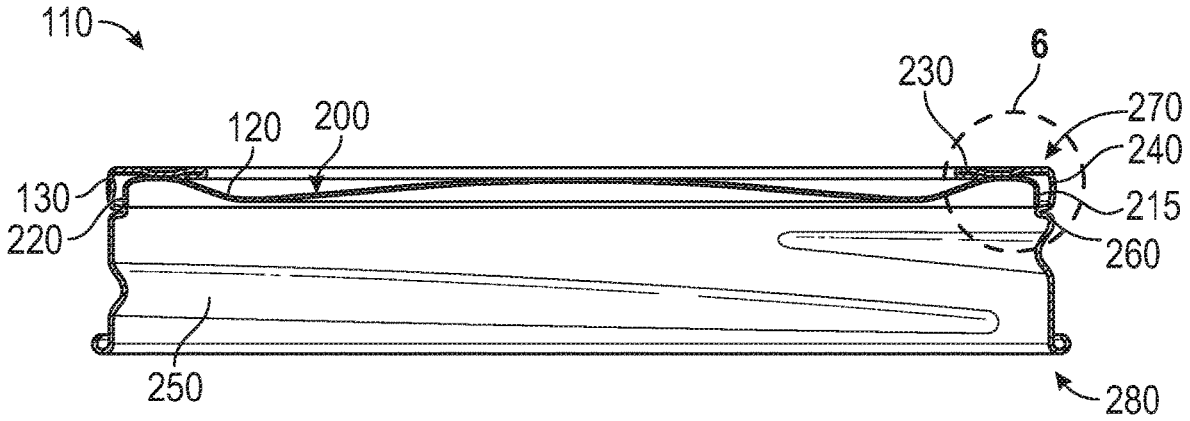
FIG. 4 illustrates a cross-sectional view of the seal releasing lid assembly at the line A-A.

FIG. 4 illustrates a cross-sectional view of one example of the seal releasing lid assembly 110 at the line 4-4 shown in FIG. 3. The seal releasing lid assembly 110 includes a decoupling configuration including the release ridge 260 engaged along the lid wall 210. The decoupling configuration includes slidably coupling the release ridge 260 with the lid wall 210. In an example, the retaining and releasing ring 130 is configured to deflect, such that engagement of the retaining and releasing ring 130 with the lid 120 causes a portion of the retaining and releasing ring 130 to deflect outward as the ridge 260 slides along the lid wall 210. The deflection of the retaining and releasing ring 130, in some examples, facilitates the reception of the lid 120 within the retaining and releasing ring 130. Additionally, the deflection of the retaining and releasing ring 130 facilitates the slidable coupling of the release ridge 260 with the lid wall 210, for instance as the releasing ring 130 is coupled with the container 100.

The seal releasing lid assembly 110 includes a release-ready configuration including the release ridge 260 seated beneath the lid edge 220, as shown in FIG. 4. An inner dimension of the release ridge 260 (e.g., its diameter, profile or the like) is less than the outer dimension of the lid edge 220 (also a diameter, profile or the like). In an example, the inner dimension of the release ridge 260 is equal to 2.670 inches. In another example, the outer dimension of the lid edge 220 ranges from 2.672 inches to 2.682 inches. The retaining and releasing ring 130 is configured to allow the release ridge 260 to slide over, or along, the slidable coupling surface 215, for instance with coupling of the retaining and releasing ring 130 over the container 100 including the lid 120. After passing of the release ridge 260 over the lid edge 220 the release ridge 260 deflects inwardly and is seated proximate to the lid edge 220, for instance, beneath the lid edge 220. In the example release-ready configuration, shown in FIG. 4, the lid 120 is retained within the retaining and releasing ring 130.

Figure 5:
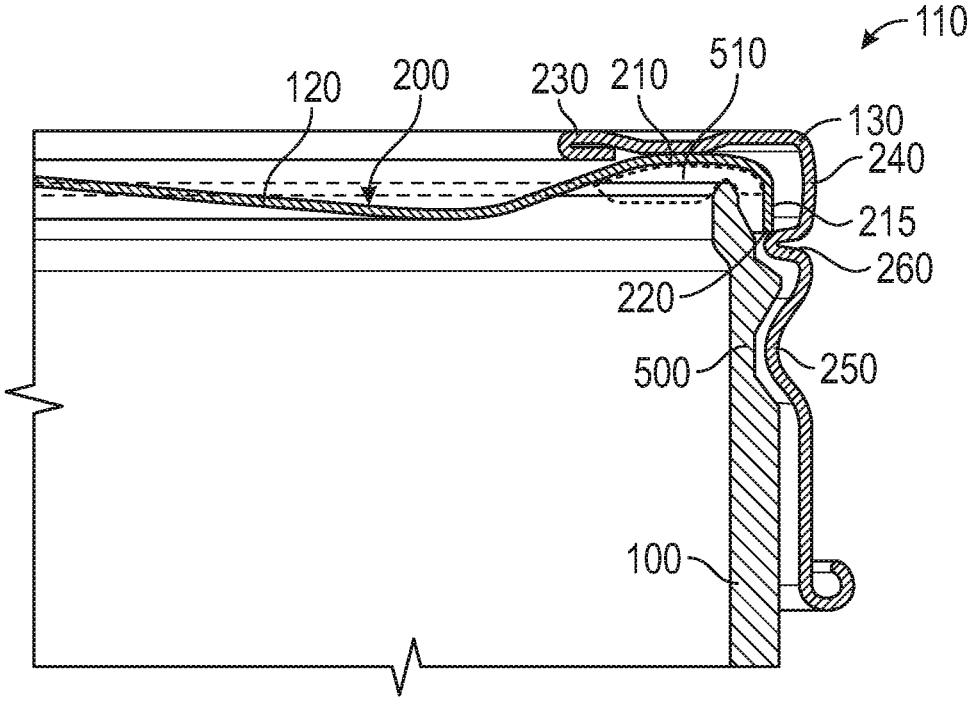
FIG. 5 illustrates a cross-sectional view of the container with the seal releasing lid assembly.

FIG. 5 illustrates a detailed cross-sectional view of one example of the container 100 with the seal releasing lid assembly 110 in the release-ready configuration. The lid 120 optionally includes a gasket material 510 shown in broken lines in FIG. 5. The gasket material 510 is optionally a pliable material, and includes, but is not limited to, a plastisol. Optionally, the gasket material 510 is coupled with the lid 120 with an adhesive or the like. In another example, the gasket material 510 is applied to the container 100, or the lid 120, prior to coupling the lid 120 with the container 100. The gasket material 510 enhances the seal between the lid 120 and the container 100.

The container 100 optionally includes container threading 500. The container threading 500 corresponds to, or is compatible with, the threading bead 250 of the retaining and releasing ring 130 (shown in FIG. 2). In some examples, engagement of the threading bead 250 with the container threading 500 and movement therebetween facilitates the coupling of the releasing and retaining ring 130 with the container 100 and is also used with the release ridge 260 to decouple the lid 120 from the container 100 (e.g., overcome the seal). As discussed herein, the release ridge 260 is seated beneath the lid edge 220 in the release-ready configuration. The engagement of the release ridge 260 with the lid edge 220, for instance through relative movement between the threading bead 250 and the container threading 500, biases the lid surface 200 away from the container 100. For instance, the release ridge 260 of the retaining and releasing ring 130 engages with the lid 120 during unscrewing of the retaining and releasing ring 130 from the container 100. The retaining and releasing ring 130 and the release ridge 260 of the ring move upward relative to the container 100.

As the retaining and releasing ring 130 moves, the release ridge 260 engages the lid, such as the lid edge 220, and biases the lid 120 away from the container 100. In one example, biasing the lid 120 away from the container 100 includes separating the lid 120 from the container 100. In another example, biasing the lid 120 away from the container 100 includes breaking the seal (e.g., a vacuum seal) between the lid 120 and the container 100.

The biasing of the lid 120 away from the container 100 by the release ridge 260 eases the removal of the lid 120 from the container 100. Instead of prying the lid 120 from the container 100 (e.g., by hand or with a tool such as a screw driver or knife), the decoupling of the retaining and releasing ring 130 from the container is used to also break the seal and decouple the lid 120. Breaking the seal between the lid 120 and the container 100 reduces the effort required to separate the lid 120 from the container 100.

As previously discussed herein, the retaining and releasing ring 130 includes the decoupling configuration and the release-ready configuration. Decoupling of the retaining and releasing ring 130 is, in one example, used to decouple the lid 120 from the container 100, for instance by overcoming a seal through engagement and bias between the release ridge 260 and the lid (e.g., the lid edge 220). In another example, the release ridge 260 is optionally configured to slide over the lid edge 220 as the retaining and releasing ring 130 transitions from the release-ready configuration to the decoupling configuration. This allows for removal of the retaining and releasing ring 130 from the lid 120 and the container 100 while the seal between lid and the container are maintained. For instance, the release ridge 260 slides along the lid wall 210, such as along the slidable coupling surface 215 without breaking the seal between the lid 120 and the container 100. In some examples, interaction with the lid 120 (e.g., the application of a force to the lid surface 200, such as by hand) while the release ridge 260 transitions from the release-ready configuration to the decoupling configuration prevents the release ridge 260 from biasing the lid surface 200 away from the container 100 (e.g., breaking the seal). The release ridge 260 is biased away from the lid edge 220 with decoupling of the ring 130 (e.g., relative rotation between threading) and deflection of the ring wall 240. As the release ridge 260 slides over the lid edge 220 it is unseated from the lid edge and decoupling of the lid 120 from the container 100 is prevented. The retaining and releasing ring 130 is then readily used with other lids 120 and containers 100 in the manner of a tool. For instance, the ring 130 is selectively coupled with a container 100 and lid 120, and then transitioned from the decoupling configuration (with the release ridge 260 slid along the slidable coupling surface 215 of the lid) to the release-ready configuration (with the ridge 260 seated relative to the lid edge 220). Operation of the retaining and releasing ring 130 from the release-ready configuration is used to decouple the lid 120.

Figure 6:
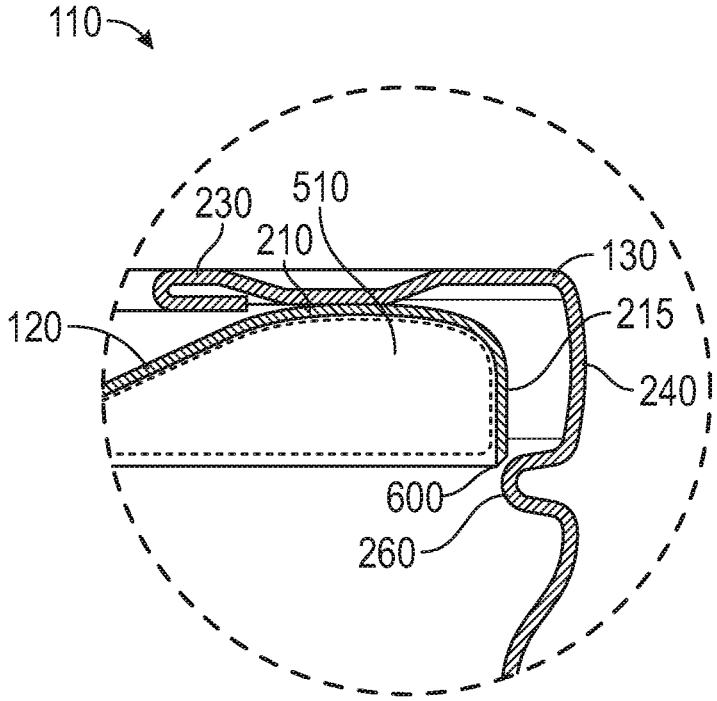
FIG. 6 illustrates a detailed view of the seal releasing assembly of FIG. 4 at the line B.

FIG. 6 illustrates a detailed view of one example of the seal releasing assembly 110 of FIG. 4 at the line B. The lid 120 optionally includes a lid peak 600 such as at the transition from the lid wall 210 to the lid edge 220. In some instances, the lid peak 600 is aligned with the lid wall 210. In an example, the lid peak 600 is produced by beveling the lid edge 220. The lid peak 600 prevents slipping between the release ridge 260 and the lid edge 220 and accordingly assists in biasing the lid 120 away from the container 100. In some instances, the release ridge 260 is configured for engagement with the lid peak 600 to bias the lid surface 200 away from the container 100. For instance, the lid peak 600 and the release ridge 260 include complementary surfaces (e.g., knurled, surface to surface engagement opposed to a slipping direction or the like) that promote engagement of the ridge to the lid peak 600 to ensure bias of the lid 120 away from the container 100 is provided by the ring 130. The release ridge 260 is optionally configured to slide over the lid peak 600 (even with engagement promoting complementary surfaces), for instance, with pressure applied to the lid 120 and toward the container 100 by hand, as the retaining and releasing ring 130 transitions from the release-ready configuration to the decoupling configuration.

Figure 7:
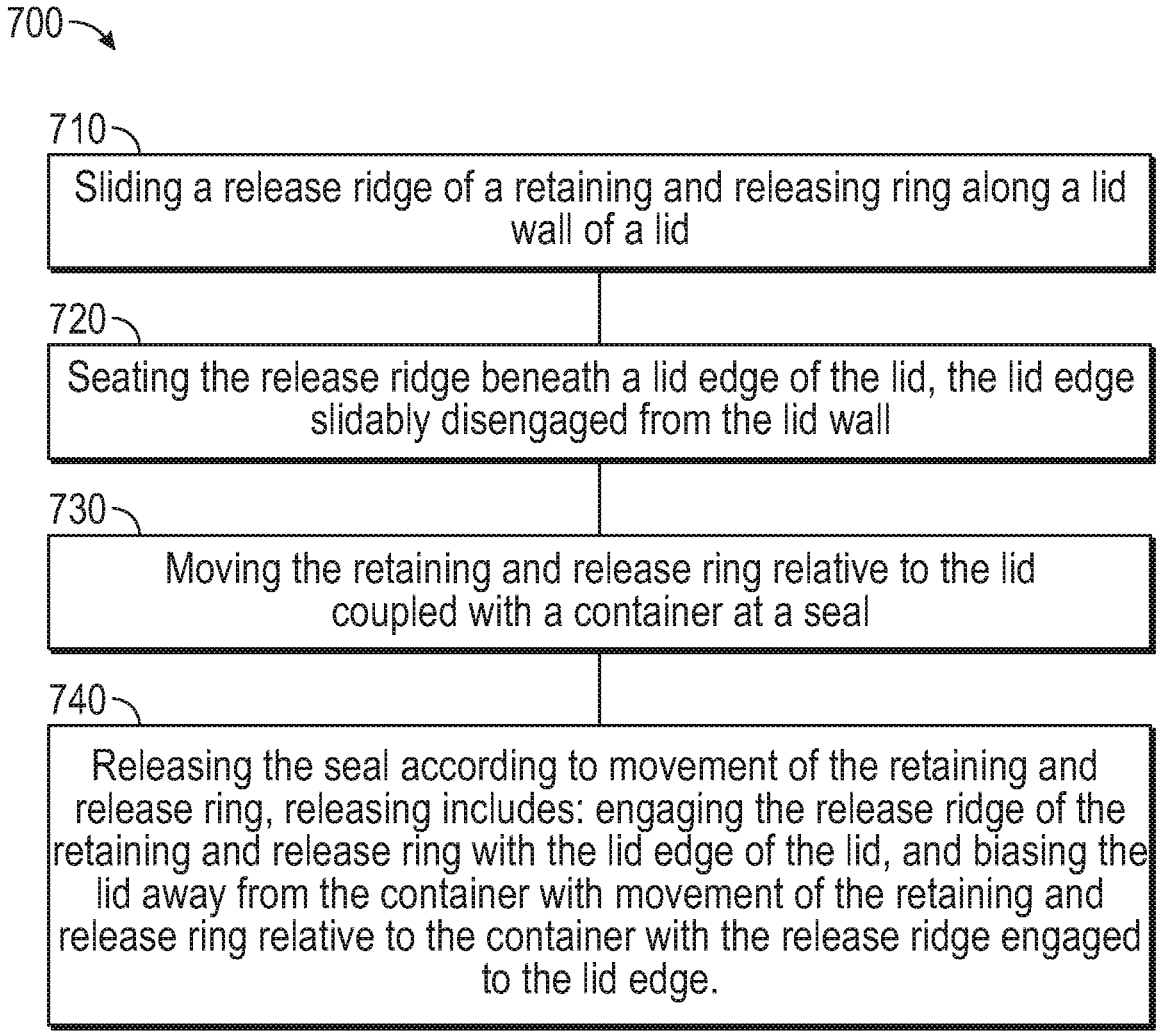
FIG. 7 illustrates a method for releasing a container seal.

FIG. 7 illustrates one example of a method 700 for releasing a container seal. In describing the method 700, reference is made to one or more components, features, functions, and operations. Where convenient, reference is made to the components, features, functions, operations and the like with reference numerals. The reference numerals provided are exemplary and are not exclusive. For instance, components, features, functions, operations and the like described in the method 1000 include, but are not limited to, the corresponding numbered elements provided herein and other corresponding elements described herein (both numbered and unnumbered) as well as their equivalents.

At operation 710 a release ridge 260 of a retaining and releasing ring 130 is slid along a lid wall 210 of a lid 120. At operation 720 the release ridge is seated beneath a lid edge 220 of the lid. The lid edge 220 is optionally configured to slidably disengage from the lid wall (e.g., during coupling of the ring 130 with the lid and container or during decoupling of the ring 130 from the lid and container).

At operation 730 the retaining and release ring is moved relative to the lid coupled with a container 100 at a seal (e.g., a portion of the container 100 that surrounds the container opening 105). At operation 740 the seal is released according to movement of the retaining and release ring. Release of the seal includes engaging the retaining and releasing ring 130 with the lid 120 and biasing the lid away from the container 100 using the ring. In one example, a release ridge 260 of the retaining and release ring 130 is engaged and presses against a lid edge 220 of the lid 120. Release of the seal optionally includes biasing the lid away from the container with movement of the retaining and release ring relative to the container. For instance, relative movement between threading of the ring 130 and the container 100 moves the ring 130 and its release ridge 260 into engagement with the lid edge 220, and continued movement biases the lid 120 from the container to release the seal.

Several options for the method 700 follow. In one example, the method 700 includes decoupling the retaining and releasing ring from the lid. In another example, decoupling the retaining and releasing ring includes sliding the release ridge of the retaining and releasing ring along the lid wall 210 toward a lid surface (e.g., the lid surface 200 of FIGS. 2-5) opposed to the lid edge. In a further option, decoupling the retaining and releasing ring 130 includes disengaging the release ridge 260 from the lid wall with the release ridge above the lid surface.

In some instances, sliding the release ridge along the lid wall and seating the release ridge beneath the lid edge include biasing the release ridge 260 toward the lid wall with a ring wall (e.g., the ring wall 240 of FIGS. 1-2 and 4-6) of the retaining and releasing ring. In yet another example, sliding the release ridge of the retaining and releasing ring along the lid wall includes sliding the release ridge of the retaining and releasing ring along the lid wall with the lid coupled with the container at the seal. In some examples, the lid remains coupled to the container at the seal while the release ridge is slid along the lid wall, for instance with pressure applied to the lid 120 by hand, tool or the like toward the container 100.

VARIOUS NOTES AND EXAMPLES

Example 1 can include a seal releasing closure assembly comprising: a lid configured for coupling across a container opening of a container, the lid includes: a lid surface, and a lid wall extending from the lid surface, the lid wall includes a lid edge and a slidable coupling surface between the lid edge and the lid surface; a retaining and releasing ring configured for coupling with the container and with the lid, the retaining and releasing ring includes: a ring flange extending over at least a portion of the lid surface, a release ridge, and a ring wall extending from the ring flange to the release ridge, the ring wall biases the release ridge inwardly toward the lid wall; and wherein the retaining and releasing ring include decoupling and release ready configurations: in the decoupling configuration the release ridge is slidably coupled along the lid wall, and in the release ready configuration the release ridge is seated beneath the lid edge and slidably disengaged from the lid wall.

Example 2 can include, or can optionally be combined with the subject matter of Example 1, to optionally include wherein in the release ready configuration engagement of the release ridge with the lid edge is configured to bias the lid surface away from the container.

Example 3 can include, or can optionally be combined with the subject matter of one or any combination of Examples 1 or 2 to optionally include wherein the retaining and releasing ring includes a threading bead, and the ring wall extends from the ring flange to the threading bead.

Example 4 can include, or can optionally be combined with the subject matter of one or any combination of Examples 1-3 to optionally include wherein the release ridge is between the ring flange and the threading bead.

Example 5 can include, or can optionally be combined with the subject matter of one or any combination of Examples 1-4 to optionally include wherein the lid edge includes a lid peak aligned with the lid wall.

Example 6 can include, or can optionally be combined with the subject matter of Examples 1-5 to optionally include wherein the release ridge is configured for engagement with the lid peak to bias the lid surface away from the container.

Example 7 can include, or can optionally be combined with the subject matter of Examples 1-6 to optionally include wherein the release ridge is configured to slide over the lid peak as the retaining and releasing ring transitions from the release ready configuration to the decoupling configuration.

Example 8 can include, or can optionally be combined with the subject matter of Examples 1-7 to optionally include wherein the release ridge is configured to slide over the lid edge as the retaining and releasing ring transitions from the release ready configuration to the decoupling configuration.

Example 9 can include, or can optionally be combined with the subject matter of Examples 1-8 to optionally include wherein the retaining and releasing ring includes a decoupled configuration, and in the decoupled configuration the release ridge is above the lid surface and slidably disengaged from the lid wall.

Example 10 can include, or can optionally be combined with the subject matter of Examples 1-9 to optionally include wherein the ring wall biases the release ridge toward the lid wall in the decoupling configuration, and the ring wall is configured to bias the release ridge to seat beneath the lid edge as the release ridge transitions from the decoupling configuration to the release ready configuration.

Example 11 can include, or can optionally be combined with the subject matter of Examples 1-10 to optionally include a method for releasing a container seal comprising: sliding a release ridge of a retaining and releasing ring along a lid wall of a lid; seating the release ridge beneath a lid edge of the lid, the lid edge slidably disengaged from the lid wall; moving the retaining and release ring relative to the lid coupled with a container at a seal; and releasing the seal according to movement of the retaining and release ring, releasing includes: engaging the release ridge of the retaining and release ring with the lid edge of the lid, and biasing the lid away from the container with movement of the retaining and release ring relative to the container with the release ridge engaged to the lid edge.

Example 12 can include, or can optionally be combined with the subject matter of Examples 1-11 to optionally include decoupling the retaining and releasing ring from the lid.

Example 13 can include, or can optionally be combined with the subject matter of Examples 1-12 to optionally include wherein decoupling the retaining and releasing ring includes: sliding the release ridge of the retaining and releasing ring along the lid wall toward a lid surface opposed to the lid edge, and disengaging the release ridge from the lid wall with the release ridge above the lid surface.

Example 14 can include, or can optionally be combined with the subject matter of Examples 1-13 to optionally include wherein sliding the release ridge along the lid wall and seating the release ridge beneath the lid edge includes biasing the release ridge toward the lid wall with a ring wall of the retaining and releasing ring.

Example 15 can include, or can optionally be combined with the subject matter of Examples 1-14 to optionally include wherein sliding the release ridge of the retaining and releasing ring along the lid wall includes sliding the release ridge of the retaining and releasing ring along the lid wall with the lid coupled with the container at the seal.

Each of these non-limiting examples can stand on its own, or can be combined in various permutations or combinations with one or more of the other examples.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular" "round", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described examples (or one or more aspects thereof) can be used in combination with each other. Other embodiments can be used, such as by one of ordinary skill in the art upon reviewing the above description. The Abstract is provided to comply with 37 CFR. § 1.72(b), to allow the reader to quickly ascertain the nature of the technical disclosure. It is submitted with the understanding that it will not be used to interpret or limit the scope or meaning of the claims. Also, in the above Detailed Description, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A seal releasing closure assembly comprising:

a lid configured for coupling across a container opening of a container, the lid includes:

a lid surface, a lid wall extending from the lid surface, the lid wall includes a lid edge and a slidable coupling surface between the lid edge and the lid surface, and a lid peak aligned with the lid wall;

a retaining and releasing ring configured for coupling with the container and with the lid, the retaining and releasing ring includes:

a ring flange extending over at least a portion of the lid surface, a release ridge, and a ring wall extending from the ring flange to the release ridge, the ring wall biases the release ridge inwardly toward the lid wall;

wherein the retaining and releasing ring includes decoupling and release ready configurations:

in the decoupling configuration the release ridge is slidably coupled along the lid wall, and in the release ready configuration the release ridge is seated beneath the lid edge and slidably disengaged from the lid wall; and wherein the release ridge is configured to slide over the lid peak as the retaining and releasing ring transitions from the release ready configuration to the decoupling configuration.

2. The assembly of claim 1, wherein in the release ready configuration engagement of the release ridge with the lid edge is configured to bias the lid surface away from the container.

3. The assembly of claim 1, wherein the retaining and releasing ring includes a threading bead, and the ring wall extends from the ring flange to the threading bead.

4. The assembly of claim 3, wherein the release ridge is between the ring flange and the threading bead.

5. The assembly of claim 1, wherein the release ridge is configured for engagement with the lid peak to bias the lid surface away from the container.

6. The assembly of claim 1, wherein the release ridge is configured to slide over the lid edge as the retaining and releasing ring transitions from the release ready configuration to the decoupling configuration.

7. The assembly of claim 1, wherein:

the decoupling configuration comprises a first decoupling configuration and a second decoupling configuration, in the first decoupling configuration the release ridge is slidably coupled along the lid wall, and in the second decoupling configuration the release ridge is above the lid surface and slidably disengaged from the lid wall.

8. The assembly of claim 1, wherein the ring wall biases the release ridge toward the lid wall in the decoupling configuration, and the ring wall is configured to bias the release ridge to seat beneath the lid edge as the release ridge transitions from the decoupling configuration to the release ready configuration.

9. A method for sealing a container or releasing a container seal comprising:

sliding a release ridge of a retaining and releasing ring along a lid wall of a lid;

seating the release ridge beneath a lid edge of the lid, the release ridge slidably disengaged from the lid wall;

moving the retaining and release ring relative to the lid coupled with a container at a seal; and decoupling the retaining and releasing ring from the lid, wherein the decoupling includes sliding the release ridge over a lid peak of the lid, and the lid peak is aligned with the lid wall.

10. The method of claim 9 comprising releasing the seal according to movement of the retaining and release ring, releasing includes:

engaging the release ridge of the retaining and release ring with the lid edge of the lid, and biasing the lid away from the container with movement of the retaining and release ring relative to the container with the release ridge engaged to the lid edge.

11. The method of claim 9, wherein decoupling the retaining and releasing ring includes:

sliding the release ridge of the retaining and releasing ring along the lid wall toward a lid surface opposed to the lid edge, and disengaging the release ridge from the lid wall with the release ridge above the lid surface.

12. The method of claim 9, wherein sliding the release ridge along the lid wall and seating the release ridge beneath the lid edge includes biasing the release ridge toward the lid wall with a ring wall of the retaining and releasing ring.

13. The method of claim 9, wherein sliding the release ridge of the retaining and releasing ring along the lid wall includes sliding the release ridge of the retaining and releasing ring along the lid wall with the lid coupled with the container at the seal.

* * * * *